United States Patent [19]

Pingston

[11] Patent Number: 4,891,920

[45] Date of Patent: Jan. 9, 1990

[54] ACOUSTICAL WALL PANEL

[75] Inventor: Robert D. Pingston, Brighton, Mich.

[73] Assignee: N.A.I. Acoustical Interiors, Inc., Warren, Mich.

[21] Appl. No.: 190,142

[22] Filed: May 4, 1988

[51] Int. Cl.[4] ..... E04B 1/84; E04B 1/343

[52] U.S. Cl. ..... 52/145; 52/202; 52/220; 52/420; 52/464; 52/476; 52/584; 181/287; 181/290

[58] Field of Search ..... 52/220, 239, 241, 243, 52/243.1, 144, 145, 419, 420, 475, 476, 477, 221, 468, 471, 202, 656, 242, 584, 582, 464; 181/290, 284, 287, 295

[56] References Cited

U.S. PATENT DOCUMENTS

| | | | |
|---|---|---|---|
| 3,121,262 | 2/1964 | Loncoske | 181/290 |
| 3,316,624 | 5/1967 | Brudevold | 52/221 X |
| 3,380,210 | 4/1968 | Neal et al. | 52/468 |
| 3,423,892 | 1/1969 | Rimington | 52/241 |
| 3,471,629 | 10/1969 | O'Leary | 52/221 X |
| 3,868,802 | 3/1975 | Schubach | 52/471 X |
| 3,971,867 | 7/1976 | Randall | 181/290 X |
| 4,041,667 | 8/1977 | Lindner et al. | 52/241 X |
| 4,163,348 | 8/1979 | Thomas, Jr. | 52/241 |
| 4,296,579 | 10/1981 | Proud | 52/239 |
| 4,719,731 | 1/1988 | Ravotti et al. | 52/239 |

*Primary Examiner*—David A. Scherbel
*Assistant Examiner*—Anthony W. Williams
*Attorney, Agent, or Firm*—Krass and Young

[57] ABSTRACT

An acoustical wall panel assembly in which each wall panel includes a rectangular metallic frame member, an acoustical core panel fixedly secured within the frame, and a decorative panel. The decorative panel is removably secured to the frame by a plurality of adhesive strip members. The wall panel assembly further includes an upper track having a downwardly extending flange portion and a cover panel secured adjacent the vertical edges of adjacent panels. The cover panel has flange portions overlying the vertical side edges of the decorative panels. The adhesive strip members, the upper and lower tracks, and the flange portions of the cover panels coact to firmly maintain the decorative panels in position relative to the frame members.

16 Claims, 4 Drawing Sheets

ACOUSTICAL WALL PANEL

BACKGROUND OF THE INVENTION

This invention relates to acoustical wall panels and, more particularly, to an acoustical wall panel assembly in which a plurality of acoustical wall panels are arranged in side-by-side fashion to form a wall.

Acoustical wall panels are commonly utilized in situations where it is desired to divide large building areas into smaller areas and simultaneously provide sound deadening or insulation as between the various subdivided areas. The acoustical wall panels typically are arranged in side-by-side relation to form the total wall assembly with means provided at the confronting edges of the panels to secure the panels together to provide the total wall. Whereas many forms of acoustical wall panel assemblies have been proposed and to some extent commercialized, all of the prior art acoustical wall panel assemblies incorporate one or more disadvantages. Specifically, the prior art acoustical wall panel assemblies are difficult to erect and/or to disassemble and it is very difficult, time consuming and expensive to replace or repair a damaged wall panel.

SUMMARY OF THE INVENTION

This invention is directed to the provision of an acoustical wall panel and wall panel assembly wherein the wall panels may be readily assembled and disassembled and wherein damages panels may be readily and inexpensively repaired or replaced.

The acoustical wall panel of the invention comprises a rigid rectangular frame; and acoustical core panel fixedly secured within the frame; a decorative panel having the same nominal dimensions as the frame; and means removably securing the decorative panel to one side face of the frame in overlying relation to the acoustical core panel. This arrangement allows the decorative panel to be readily removed for repair and replacement in the event that the panel is damaged.

According to a further feature of the invention, the means for removably securing the decorative panel to the frame includes strip members arranged along at least two side edges of the frame and presenting an adhesive outer face for sticking, removable securement to the inner face of the decorative panel. This simple and inexpensive arrangement allows the decorative panels to be readily affixed to the outer face of the frame and readily removed from the frame for repair or replacement in the event that the panel is damaged.

According to a further feature of the invention, a plurality of acoustical wall panels as described are provided; means are provided for mounting the panels in side-by-side relation with a vertically extending space between each pair of panels; and a plurality of cover panels are provided. The cover panels are sized to cover the vertically extending spaces between the wall panels and each includes means extending into a respective vertically extending space to secure the cover panel in vertical relation between the respective pair of wall panels and each further includes flange portions along each vertical edge of the cover panel arranged in overlying relation to the adjacent vertical edge portions of the decorative panels of the respective pair of wall panels to maintain the decorative panels position against the frames of the respective wall panels. This arrangement provides a simple and effective means of filling the spaces between the adjacent wall panels and simultaneously maintaining the decorative wall panels in position against the frames of the wall panels.

According to a further feature of the invention the acoustical wall panel assembly further includes an upper elongated track having a central horizontal web portion extending along and above the upper portion of the frames of the side-by-side wall panels and a vertical flange portion on one side of the web portion extending downwardly in overlying relation to the upper edge portions of the decorative panels of the wall panels to further maintain the decorative panels positioned adjacent the frames of the wall panels.

According to a further feature of the invention, the acoustical wall panel assembly further includes a lower elongated track having a central horizontal web portion extending along and below the lower portion of the frames of the side-by-side wall panels and a vertical flange portion on one side of the web portion extending upwardly in overlying relation to the lower edge portions of the decorator panels of the wall panels to further maintain the decorator panels' positioned adjacent the frames.

According to a further feature of the invention, a pair of laterally spaced vertical tracks are defined on the vertical side edges of each frame of each wall panel and the wall panel assembly further includes a plurality of pairs of clamps for use in maintaining the panels in side-by-side relation with a vertically extending space between each pair of panels. Each pair of clamps includes a first clamp adapted to hookingly engage one vertical track on the frame of one panel and the corresponding vertical track on the frame of another panel and a second clamp adapted to hookingly engage the other vertical track on the frame of the first panel and the corresponding vertical track on the frame of the second panel, and fastening means are provided which engage each pair of clamps and operate to draw the first and second clamps laterally together to firmly engage the clamps with the tracks on the frames of the wall panels.

According to a further feature of the invention, each clamp has a U-configuration including a bight portion and a pair of generally parallel arm portions; the arm portions include hook means at their free ends for hooking engagement with a respective track on the frame of the adjacent wall panel; each clamp of each pair of clamps is positioned with its bight portion disposed inwardly and its arm portions extending outwardly so as to position the bight portions of a pair of clamps in confronting relation; and the fastener means pass through the confronting bight portions of a pair of clamps.

According to a further feature of the invention, coacting means are provided on the clamps and on the cover panels which are operative to maintain each cover panel in fixed overlying relation with respect to each vertically extending space between the side-by-side wall panels.

According to a further feature of the invention, each cover panel includes a generally rectangular planar main body portion and a pair of arm portions extending in generally parallel relation from the inner face of the main body portion; a tooth is defined along the free vertical end edge of each arm portion of each cover panel; and an array of vertically extending serrations are provided on the arm portions of the clamps for coaction with the teeth on the associated cover plates to secure the cover plate adjacent the respective vertically extending space in response to insertion of the cover plate arm portions between the arms portions of the associated clamp.

According to a further feature of the invention, the upper track vertical flange portion also extends upwardly above the web portion; the upper track further includes a vertical flange portion at the other side of the web portion and extending upwardly above the web and downwardly from the web in overlying relation to the wall panels; the upper track further includes a central longitudinal partition portion extending upwardly from the web portion to divide the area above the web portion into a pair of side-by-side longitudinal raceways separated by the partition portion; and the upper frame further includes apertures in the web portion in each raceway overlying the vertically extending spaces between adjacent wall panels to allow separate conduits to be run down the raceways and through the apertures into the vertically extending spaces.

In the invention wall panel assembly, the adhesive strip members provided along the frame members of the wall panels, the flange portions of the upper and lower tracks, and the flange portions of the cover panels coact to firmly maintain the decorative panels in position relative to the frame members but allow a decorative panel to be readily replaced in the event of damage by simply removing the associated cover panels and bowing the damaged panel between its upper and lower edges to allow the upper edge portion of the panel to be withdrawn from engagement with the flange portion of the upper track and allow the lower edge portion of the panel to be withdrawn from engagement with the flange portion of the lower track with the adhesive outer faces of the strip members simultaneously releasing their sticking engagement with the inner face of the damaged panel to allow the panel to be removed for repair or replacement.

DETAILED DESCRIPTION OF THE PREFERRED EMBODIMENT

Figure 1:
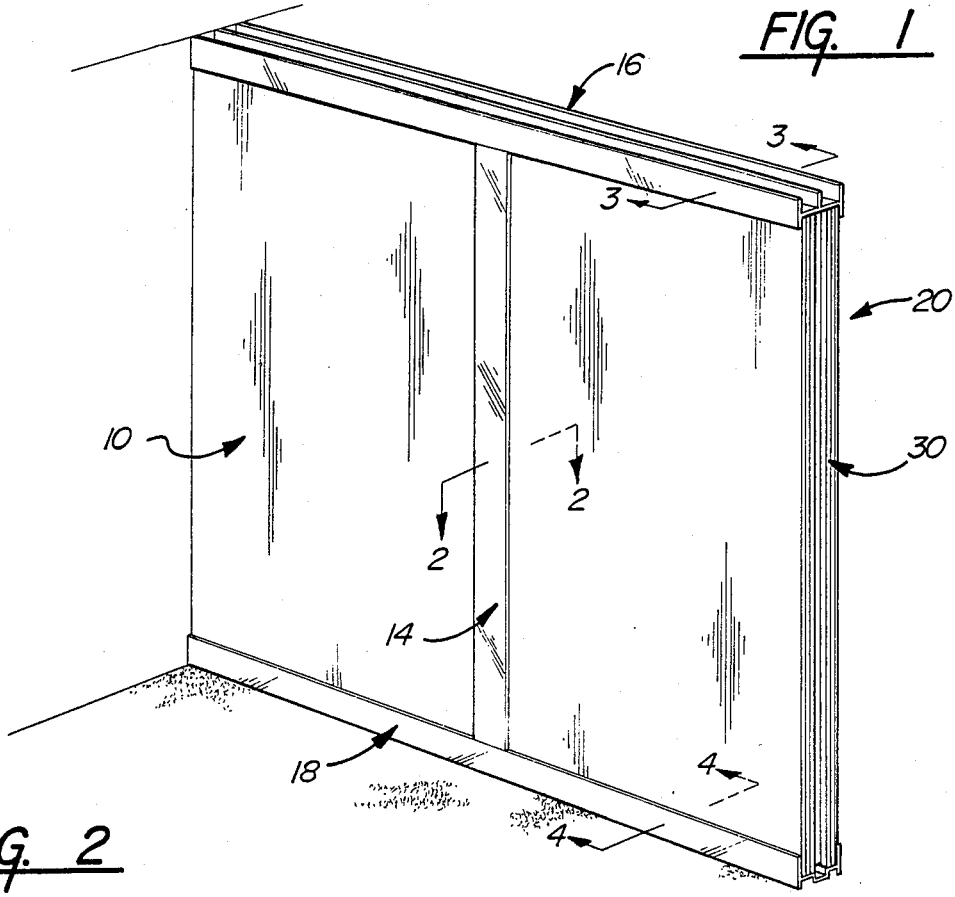
FIG. 1 is a fragmentary perspective view of the invention wall panel assembly.

The invention wall panel assembly includes a plurality of wall panels 10, a plurality of clamp pairs 12, a plurality of cover panels 14, an upper track 16, and a lower track 18.

Each wall panel 10 includes a frame member 20, an acoustical core panel 22, a pair of intermediate panels 24, a pair of decorative panels 26, and adhesive strip members 28.

Figure 2:
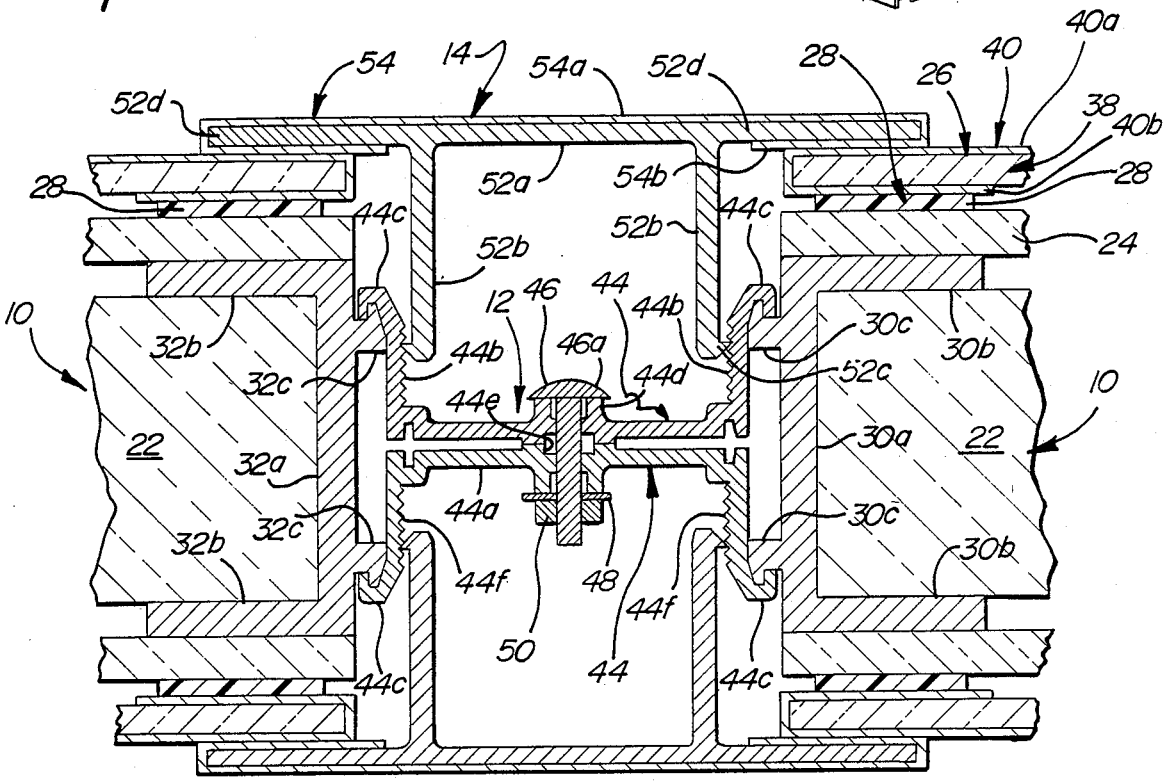
FIGS. 2, 3, and 4 are cross-sectional views taken respectively on lines 2—2, 3—3, and 4—4 of FIG. 1.
Figure 3:
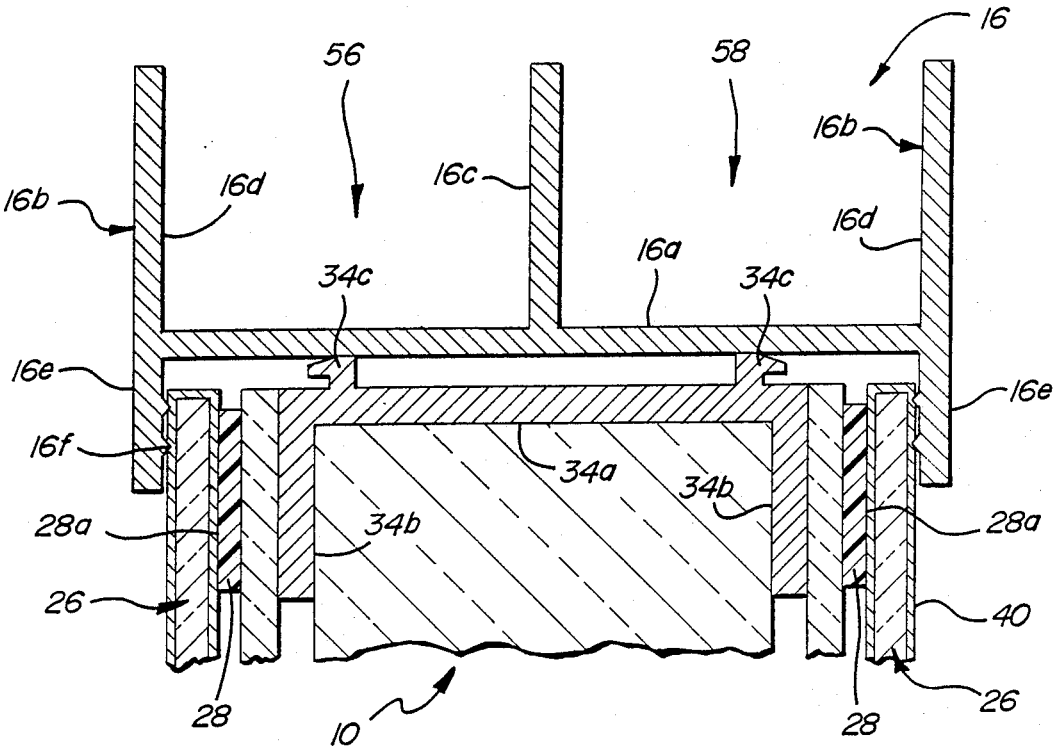
Figure 4:
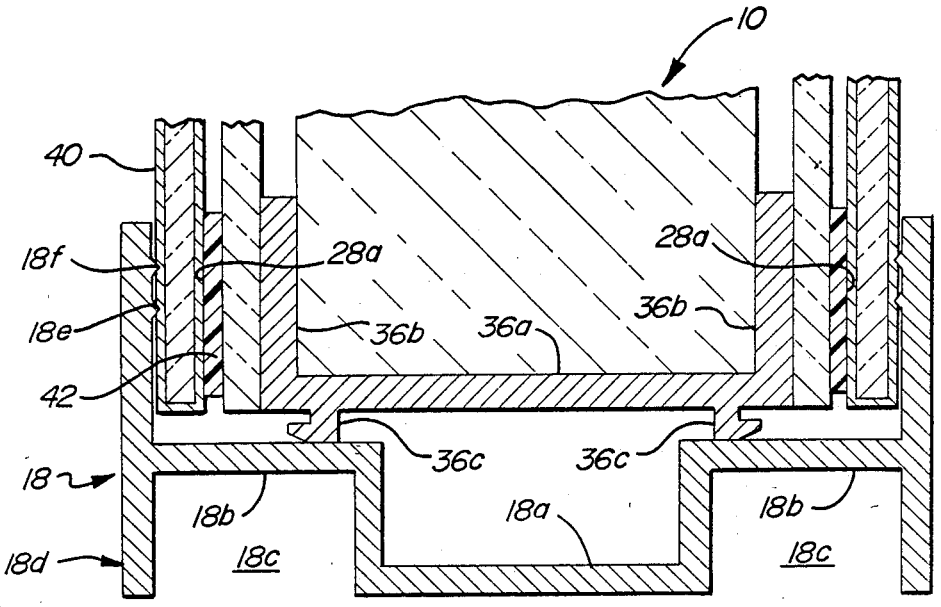
Figure 6:
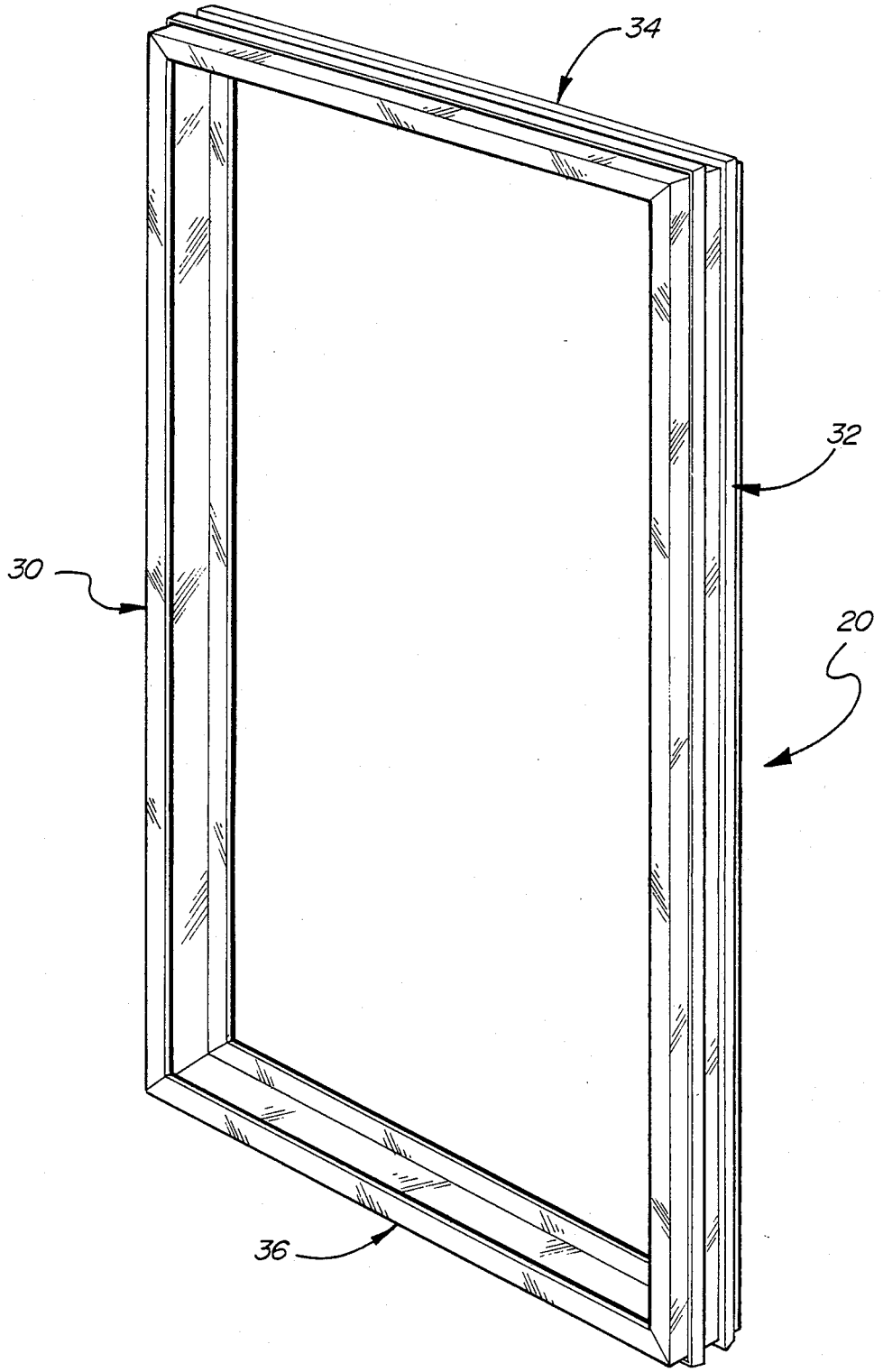
FIG. 6 is a perspective view of a frame utilized in the wall panels of the invention wall panel assembly.

Frame 20 is preferably formed as a series of aluminum extrusions and includes a left vertical member 30, a right vertical member 32, an upper member 34 and a lower member 36 joined together, with their adjacent ends beveled, in a welding operation to form the frame 20 best seen in FIG. 6. As best seen in FIG. 2, frame member 30 includes a central vertical web portion **30*a*, flange portions 30*b* extending in parallel fashion from each lateral end of web portion 30*a*, and a pair of track portions 30*c* integrally formed at the outer face of web portion 30*a* and having an L-shaped or hook configuration in cross section with the hook opening in each case toward the respective outboard face of the frame member. It will be understood that frame members 32,34 and 36 (see also FIGS. 3 and 4) have a similar cross-sectional configuration and each include a web portion, spaced flange portions, and spaced hook portions. As will hereinafter become apparent, the hook portions are not functionally required with the upper and lower frame members 34 and 36** but are provided on these frame members for purposes of utilizing the same frame cross section for all four frame members.

Acoustical core panel 22 is formed as a thick sheet of fiberglass insulation material and is sized to fit within the flange portions of the frame members 30, 32, 34, and 36 so as to be totally enclosed and totally surrounded by the combined flange portions of the combined frame members.

Intermediate panels 24 (FIG. 2) are formed of a thin sheet fiberglass insulation material and have the same nominal height and width dimensions as frame 20. Intermediate panels 24 are secured to the opposite side faces of the frame members by a suitable adhesive.

Decorative panels 26 include a thin fiberglass panel 38 having the same nominal height and width dimensions as frame 20 and intermediate panels 24 and a decorative covering 40 of a suitable fabric or vinyl material. Decorative covering 40 is suitably bonded to fiberglass panel 38 and includes a main body portion **40*a* overlying the outboard face of the fiberglass panel and folded under portions 40*b* covering the edge portions of the inboard face of the panel 38 along all four side edges of the panel 38**.

Strip members 28 comprise a suitable double sticky tape material. A strip member 28 is secured to the outboard face of each intermediate panel 24 along all four side edge portions of the intermediate panel and decorative panels 40 are removably secured to strips 28 by the sticking adhesion of folded under fabric portions **40*b* with the outboard sticky face of the strip members 28**.

Each clamp pair 12 includes a pair of clamps 44, 44. Each clamp 44 has a U-shaped configuration including a bight portion **44*a* and a pair of generally parallel arm portions 44*b* extending in parallel fashion from the opposite ends of bight portion 44*a* and terminating at their free vertical edges in hook portions 44*c* for hooking coaction with a respective track 30*c* or 32*c* on a respective frame member 30 or 32 of a wall panel 10. Each clamp pair also includes a bolt 46 having a head 46*a* seated on parallel ribs 44*d* formed on bight portion 44*a* and passing through aligned apertures 44*e* in the adjacent bight portions for coaction with a washer 48 seated on the ribs 44*d* of the other clamp and a nut 50. It will be understood that as nut 50 is tightened on bolt 46, the clamps are drawn together to firmly and lockingly engage the hook portions 44*c* of the clamps with the respective hook portions 30*c*, 32*c* of the frame members 30 and 32 of adjacent wall panels. Clamps 44 are preferably formed as aluminum extrusions and are provided at vertically spaced intervals in the vertically extending spaces between the adjacent wall panels. For example, for a wall panel having a height of 10 feet, four clamp pairs 12 may be provided. The confronting faces of arm portions 44*b* of each clamp 44 are provided with a series of vertically extending serrations 44*f***.

Each cover panel 14 includes a base cover member 52 formed as aluminum extrusion and including a main body portion 52a and a pair of spaced arm portions 52b extending from the inboard face of main body portion 52a in parallel relation and each including a tooth 52c extending along its free vertical edge. Main body portion 52a further defines flange portions 52d provided along each vertical edge portion of main body portion 52a respectively outboard of the arm portions 52b. Each cover panel 14 further includes a decorative cover 54 of fabric or vinyl material including a main body portion 54a covering the outer face of main body portion 52a and further including folded under portions 54b folded under the respective flange portions 52d of main body portion 52a. Covering 54 is suitably adhesively secured to main body portion 52a. Arm portions 52b of base cover member 52 are spaced apart by a distance somewhat less than spacing between arm portions 44b of clamps 44 so that arm portions 52b may fit within clamp arm portions 44b with teeth 52c cooperating in a ratcheting manner with serrations 44f to lockingly but adjustably secure cover panel 14 within the vertically extending space defined between adjacent wall panels. Each cover panel 14 has a vertical height generally corresponding to the vertical height of the associated wall panels.

Upper track 16 (FIG. 3) is preferably formed as an aluminum extrusion and includes a central web portion 16a, flange portions 16b, and a central partition portion 16c. Each flange portion 16b includes an upper portion 16d extending upwardly from web portion 16a and a lower portion 16e extending downwardly from web portion 16a. Flange portions 16b are spaced laterally by a distance such that lower flange portions 16e may embrace the opposite side faces of the acoustical wall panels 10 with the inner face of each flange portion 16e being provided with longitudinally extending teeth 16f for biting engagement with the covering 40 of the respective decorative panel 26.

Figure 5:
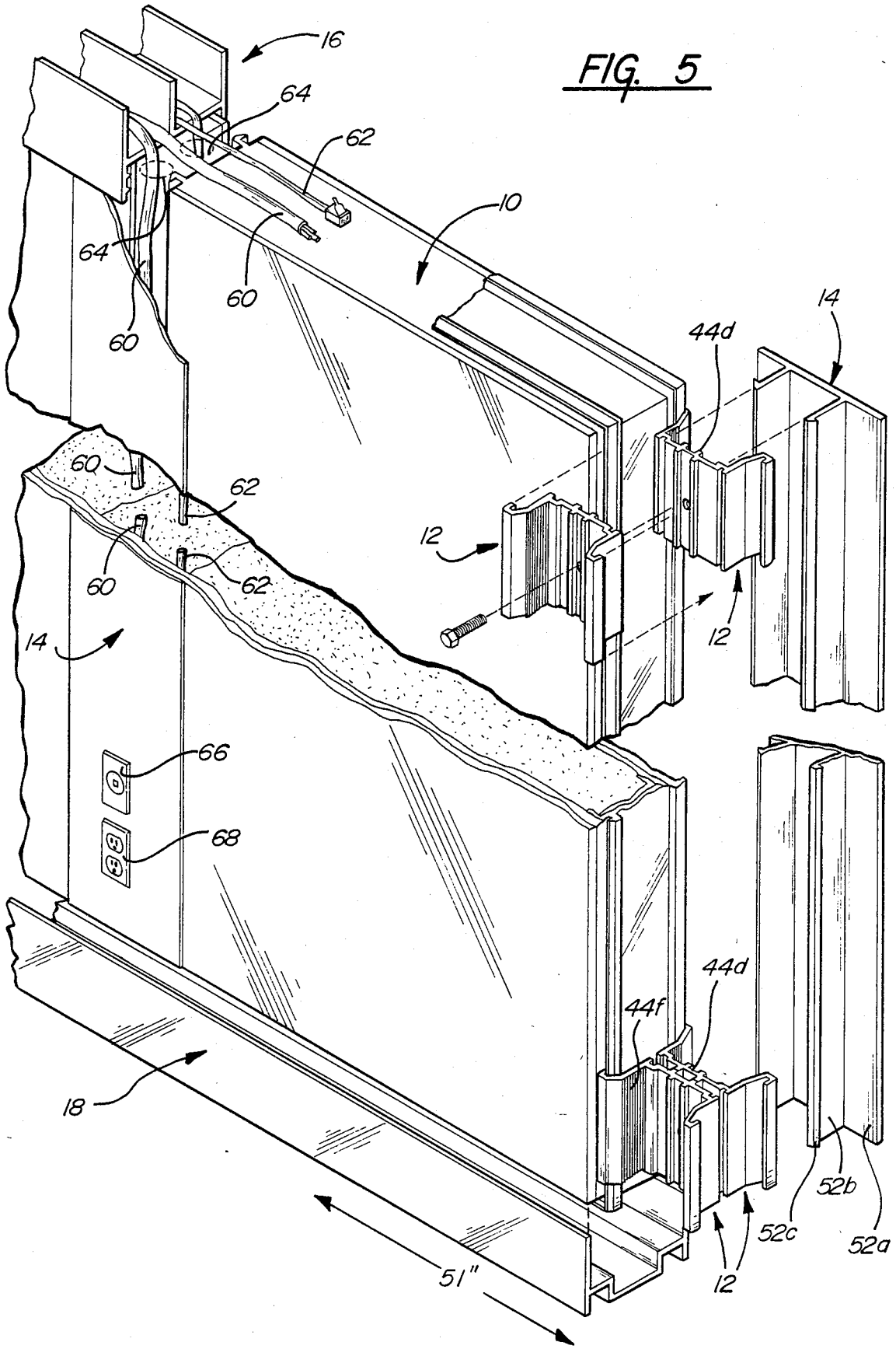
FIG. 5 is a perspective exploded fragmentary view of the invention wall panel assembly.

Central partition portion 16c extends upwardly from web portion 16a and serves to divide the area above web portion 16a into a pair of longitudinal raceways 56 and 58 on opposite sides of partition portion 16c to respectively accommodate conduits 60 and 62 (FIG. 5) which may, for example, respectively comprise a main conduit 60 carrying 110 volt power for standard electrical applications and a computer conduit 62 carrying the milliamp power typically required by computer equipment. Web portion 16a includes an aperture 64 in each raceway in overlying relation to each vertically extending space between adjacent wall panels so as to allow conduits 60 and 62 to run down their respective raceways and thence pass downwardly through a respective aperture 64 and into the vertically extending space between adjacent wall panels for connection respectively to a standard dual outlet 68 positioned in the associated cover panel 14 and a computer outlet terminal 66 also positioned in the associated cover panel 14.

Bottom track 18 (FIG. 4) is also preferably formed as an aluminum extrusion and includes a central web portion 18a, kickup portions 18b defining tunnels 18c, and flange portions 18d. Each flange portion 18d includes a portion 18e extending upwardly from kickup 18b to embrace the side face of an associated wall panel 10 with longitudinal teeth 18f provided on the inner face of flange portions 18e for gripping engagement with the fabric covering 40 on the respective decorative panels 26.

In use of the invention wall panel assembly, a plurality of acoustical wall panels 10 are arranged in side-by-side relation to form a wall dividing the associated room area into a desired pattern of smaller areas. Specifically, the side-by-side wall panels 10 sit along their lower edge portions in lower track 18 with spaced tracks 36c seated on a respective kickup 18b; the upper edge portions of the wall panels are received in the upper track 16 with upper track web portion 16a immediately overlying spaced tracks 34c; clamp pairs 12 maintain the associated wall panels in rigid, spaced relation with a vertically extending space between each pair of adjacent wall panels; and cover panels 14 are secured in overlying relation to each vertically extending space between adjacent wall panels with the cover panels held in place by the ratcheting engagement of teeth 52c with serrations 44f.

In the assembled relation of the wall panels, each decorative panel 26 is held in a removable disposition relative to the associated frame member 20 and core panel 22 by the combined action of the adhesive outer faces 28a of strip members 28 the downwardly extending overlapping action of flange portions 16e of upper track 16, the upwardly extending overlapping action of flange portions 18e of track 18, and the vertical overlapping action of the flange portions 52d of the cover panels 14.

The invention arrangement allows the ready replacement of a decorative wall panel 26 in the event that the panel is damaged. Specifically, cover plates 14 may be removed, whereafter the damaged panel 26 may be bowed between its upper and lower edges to allow the upper edge portion to be moved downwardly clear of the respective upper track flange portion 16e and allow the lower edge portion of the decorative panel to be moved upwardly clear of the respective upwardly extending flange portion 18e of the lower track. As the decorative panel is bowed and moved out of engagement with the flanges of the upper and lower tracks, the panel simultaneously is released from sticking engagement by the adhesive surfaces 28a of strips 28 so as to allow the panel to be removed for repair or replacement.

Once the damaged panel has been repaired, or once a new panel has been provided in the event of a severely damaged panel, the repaired or new panel may be readily installed in the wall assembly simply by bowing the panel, allowing the lower edge portion of the panel to move downwardly within the flange portion 18e of the lower track, allowing the upper edge portion of the panel to move upwardly within the flange portion 16e of the upper track, and replacing the associated cover panels 14 with the final fixed position of the cover panels being determined by the adjustable ratcheting movement of teeth 52c along serrations 44f. With the repaired or replaced panel thus securely held by flange portions 52d of cover panel 14 and flange portions 16e and 18e of upper and lower tracks 16 and 18, the panel is further maintained in a fixed position relative to the associated frame 20 and core panel 22 by the adhesive sticking engagement of adhesive surfaces 28a with the adjacent fabric surfaces of the decorative panels.

The invention wall assembly will thus be seen to provide an arrangement whereby a complete wall may be readily and inexpensively erected and wherein a damaged panel may be readily and inexpensively repaired without need to disassemble the wall and/or disconnect any of the electrical connections associated with the wall. The dual raceway provided by the divided upper track also provides a ready and efficient means of separating the computer power conduit from the main power conduit so as to avoid electrical interference as between these conduits.

Whereas a preferred embodiment of the invention has been illustrated and described in detail, it will be apparent that various changes may be made in the disclosed embodiment without departing from the scope or spirit of the invention.

I claim:

1. An acoustical wall panel assembly comprising:

(A) a plurality of vertical acoustical wall panels with each panel including (1) a rigid rectangular hollow frame having spaced parallel left and right vertical members and spaced parallel upper and lower horizontal members, (2) an acoustical core panel fixedly secured within said frame, and (3) a decorative panel having the same nominal dimensions as said frame and positioned adjacent said frame;

(B) means mounting said vertical wall panels in side-by-side relation with a vertically extending later space between the left vertical frame member of one panel and the right vertical frame member of the adjacent panel; and (C) a plurality of cover panels sized to cover said vertically extending lateral spaces and each having means extending into a respective vertically extending lateral space to secure said cover panel in vertical relation between a respective pair of wall panels and having flange portions along the respective vertical edges thereof arranged in overlying relation to the adjacent vertical edge portions of the decorative panels of the respective pair of wall panels to maintain said decorative panels positioned against the vertical frame members of the respective pair of wall panels.

2. An acoustical wall panel assembly according to claim 1 wherein said assembly further includes:

(D) an upper elongated track having a central horizontal web portion extending along and above the upper portions of said frames of said side-by-side wall panels and a vertical flange portion on one side of said web portion and extending downwardly in overlying relation to the upper edge portions of said decorative panels of said wall panels to further maintain said decorative panels positioned against the frames of the respective wall panels.

3. An acoustical wall panel assembly according to claim 2 wherein said assembly further includes:

(E) a lower elongated track having a central horizontal web portion extending along and below the lower portions of said frames of said side-by-side wall panels and a vertical flange portion on one side of said web portion and extending upwardly in overlying relation to the lower edge portions of said decorative panels of said wall panels to further maintain said decorative panels positioned against the frames of the respective wall panels.

4. An acoustical wall panel assembly according to claim 3 wherein said assembly further includes:

(F) strip members arranged along at least two side edges of each frame and presenting an adhesive outer face for sticking, removal securement to the inner face of the respective decorative panel.

5. A wall panel assembly according to claim 2 wherein:

(E) said upper track vertical flange portion also extends upwardly above said web portion;

(F) said upper track further includes a vertical flange portion at the other side of said web portion and extending upwardly above said web portion and downwardly from said web portion in overlying relation to said wall panels;

(G) said upper track further includes a central longitudinal partition portion extending upwardly from said web portion to divide the area above said web portion into a pair of side-by-side longitudinal raceways separated by said partition portion; and (H) said upper track further includes apertures in said web portion in each raceway overlying said vertically extending spaces between adjacent wall panels to allow separate conduits to be run down said raceways and through said apertures into said vertically extending spaces.

6. A wall assembly comprising:

(A) a plurality of acoustical wall panels with each panel including a rigid rectangular hollow frame having spaced parallel left and right vertical members and spaced parallel upper and lower horizontal members, and an acoustical core panel fixedly secured within said frame;

(B) means defining a pair of spaced vertical tracks on the outboard vertical side edges of the vertical members of each frame;

(C) a plurality of pairs of clamps for use in maintaining said panels in side-by-side relation with a vertically extending lateral space between the left vertical frame member of one panel and the right vertical frame member of an adjacent panel, each pair of clamps including a first clamp adapted to hookingly engage one vertical track on the left vertical frame member of one panel and the corresponding vertical track on the right vertical frame member of the adjacent panel and a second clamp adapted to hookingly engage the other vertical track on the left vertical frame member of said one panel and the corresponding vertical track on the right vertical frame member of said adjacent panel;

(D) fastener means engaging each pair of clamps and adapted to draw said first and second clamps laterally together to firmly engage said clamps with said tracks;

(E) a plurality of cover panels having a width exceeding the width of said vertically extending lateral spaces; and (F) coacting means on said clamps and on said cover panels operative to maintain each cover panel in fixed overlying relation with respect to a respective vertically extending lateral space with the respective vertical edge portions of each panel respectively overlying the left vertical frame of one panel and the right vertical frame of an adjacent panel.

7. A wall panel assembly according to claim 6 wherein:

(G) said coacting means comprise ratcheting means on said clamps and on said cover panels.

8. A wall panel assembly according to claim 7 wherein:

(H) each clamp has a U-configuration including a bight portion and a pair of generally parallel arm portions;

(I) said arm portions include hook means at their free end edges for hooking engagement with a respective track on the frame of an adjacent wall panel;

(J) said fastener means pass through the bight portions of a pair of clamps;

(K) each cover panel includes a generally rectangular, planar main body portion and a pair of arm portions extending in generally parallel relation from the inner face of said main body portion; and (L) said ratcheting means includes a tooth defined along the free vertical end edge of each arm portion of each cover panel and an array of vertically extending serrations on the arm portions of each clamp for coaction with the teeth on the associated cover plate to secure the cover panel adjacent the respective vertically extending space in response to insertion of said cover panel arm portions between the arm portions of the associated clamp.

9. A wall panel assembly according to claim 6 wherein:

(G) each wall panel further includes a decorative panel having the same nominal dimensions as said frame and positioned adjacent one side of said frame, and said main body portion of each cover panel includes opposite vertical flange portions arranged in overlying relation to the adjacent vertical edge portions of the decorative panels of the respective pair of wall panels to maintain said decorative panels positioned against said frames.

10. A wall panel assembly according to claim 6 wherein:

(G) each clamp has a U-configuration including a bight portion and a pair of generally parallel arm portions:

(H) said arm portions include hook means at their free end edges for hooking engagement with a respective track on the adjacent panel;

(I) each clamp of each pair of clamps is positioned with its bight portion disposed inwardly and its arm portions extending outwardly so as to position the bight portions of a pair of clamps in confronting relation; and (J) said fastener means pass through the confronting bight portions of a pair of clamps.

11. An acoustical wall panel assembly comprising:

(A) a plurality of acoustical wall panels with each panel including (1) a rigid rectangular frame, (2) an acoustical core panel fixedly secured within said frame, and (3) a decorative panel having the same nominal dimensions as said frame and removably positioned adjacent one side face of said frame;

(B) an upper track positioned over a plurality of said wall panels arranged in side-by-side relation with a vertically extending lateral space between each pair of panels, said upper track including a downwardly extending flange portion positioned in overlying relation to the upper edge portions of the decorative panels of the side-by-side wall panels to maintain the upper edge portions of said decorative panels adjacent said frames;

(C) a lower track extending beneath said plurality of side-by-side wall panels and including a vertical flange portion extending upwardly in overlying relation to the lower edge portions of the decorative panels of the side-by-side wall panels to maintain the lower edge portions of said decorative panels positioned adjacent said frames, (D) a plurality of cover panels sized to cover said vertically extending lateral spaces and each having means extending into a respective vertically extending lateral space to secure said cover panel in vertical relation between the respective pair of wall panels and further having flange portions along each vertical edge thereof arranged in overlying relation to the adjacent vertical side edge portions of the decorative panels of the respective pair of wall panels to maintain the side edge portions of said decorative panels positioned adjacent said frames.

12. An acoustical wall panel assembly according to claim 11 wherein:

(E) each acoustical wall panel further includes means adhesively but releasably securing the inner face of the decorative wall panel adjacent said one side face of said frame member to facilitate the maintaining action of the flange portions of the upper and lower tracks and the flange portions of the cover panels.

13. An acoustical wall panel assembly according to claim 12 wherein:

(F) said releasable securing means includes a plurality of strip members interposed between said one side face of said frame member and the adjacent inner face of said decorative panel and presenting a sticky outer surface for releasable sticking securement to the inner face of the decorative panel.

14. A wall panel assembly according to claim 13 wherein:

(G) said assembly further includes means defining a pair of laterally spaced vertical tracks on the vertical side edges of each frame;

(H) said mounting means includes a plurality of pairs of clamps with each clamp pair including a first clamp adapted to hookingly engage one vertical track on the frame of one panel and the corresponding vertical track on the frame of another panel and a second clamp adapted to hookingly engage the other vertical track on the frame of said one panel and the corresponding vertical track on the frame of said other panel; and (I) said mounting means further includes fastener means engaging each pair of clamps and adapted to draw said first and second clamps laterally together to firmly engage said clamps with said tracks.

15. A wall panel assembly according to claim 14 wherein:

(J) each clamp has a U-configuration including a bight portion and a pair of generally parallel arm portions;

(K) said arm portions include hook means at their free end edges for hooking engagement with a respective track on the frame of an adjacent wall panel;

(L) said fastener means pass through the bight portions of a pair of clamps;

(M) each cover panel includes a generally rectangular planar main body portion and a pair of arm portions extending in generally parallel relation from the inner face of said main body portion; and (N) a tooth is defined along the free vertical end edge of each arm portion of each cover panel and an array of vertically extending serrations are provided on the arm portions of said clamps for coaction with the teeth on the arm portions of the associated cover panels to secure the cover panels adjacent the respective vertically extending space in response to insertion of the cover panel arm portions between the arm portions of the associated clamp.

16. An acoustical wall panel comprising:

(A) a rigid rectangular frame;

(B) an acoustical core panel fixedly secured within said frame;

(C) a decorative panel having the same nominal dimensions as said frame, said decorative panel comprising a base panel and a decorative material covering at least the outer face of said base panel;

(D) an intermediate panel of acoustical material secured to one side of said frame;

(E) a plurality of strip members secured along all four side edges of said intermediate panel and each presenting an adhesive outer face for sticking removable securement to the inner face of said decorative panel so as to removably secure said decorative panel to said intermediate panel; and (F) said wall panel further including another intermediate panel secured to the other side face of said frame, further strip members secured to the side edges of said further intermediate panel, and a further decorative panel stickingly and removably secured to said further strip members.

* * * * *